US006079969A

United States Patent [19]

Sanders

[11] Patent Number: 6,079,969

[45] Date of Patent: Jun. 27, 2000

[54] COMPACTOR

[75] Inventor: Trevor George Sanders, Berks, United Kingdom

[73] Assignee: Thames Water Utilities Limited, United Kingdom

[21] Appl. No.: 08/860,176

[22] PCT Filed: Dec. 4, 1995

[86] PCT No.: PCT/GB95/02825

§ 371 Date: Sep. 30, 1997

§ 102(e) Date: Sep. 30, 1997

[87] PCT Pub. No.: WO96/17131

PCT Pub. Date: Jun. 6, 1996

[30] Foreign Application Priority Data

Dec. 2, 1994 [GB] United Kingdom ..... 9424412

[51] Int. Cl.[7] ..... E01C 19/40

[52] U.S. Cl. ..... 425/171; 210/271; 425/317; 425/472; 172/199; 172/772

[58] Field of Search ..... 425/317, 472, 425/171; 210/271; 404/133.2; 172/138, 199, 301, 305, 430, 735, 740, 772

[56] References Cited

U.S. PATENT DOCUMENTS

| | | | |
|---|---|---|---|
| 1,219,375 | 3/1917 | Chaffin | 172/199 |
| 1,565,752 | 12/1925 | Nichols | 210/271 |
| 1,856,148 | 5/1932 | Ball | 172/199 |
| 1,937,243 | 11/1933 | Pearch | 172/772 |
| 2,292,241 | 8/1942 | Reeves | 172/430 |
| 2,327,726 | 8/1943 | Lose, Jr. | 210/271 |
| 2,795,060 | 6/1957 | Geiszler | 172/199 |
| 3,217,620 | 11/1965 | Mindrum et al. | 404/133.2 |
| 3,847,808 | 11/1974 | Spohr | 210/271 |
| 3,909,149 | 9/1975 | Century | 404/133.2 |
| 4,098,344 | 7/1978 | Johnson | 172/199 |
| 4,190,534 | 2/1980 | Wyatt | 210/271 |
| 4,271,612 | 6/1981 | Mellingen | 172/199 |
| 4,298,555 | 11/1981 | Weltmer | 425/472 |
| 4,482,457 | 11/1984 | Jacquet | 210/271 |
| 5,062,228 | 11/1991 | Artzberger | 37/117.5 |
| 5,471,770 | 12/1995 | Ferreira | 172/772 |

FOREIGN PATENT DOCUMENTS

| | | |
|---|---|---|
| 913421 | 9/1946 | France . |
| 2173077 | 10/1973 | France . |
| 5256 | 3/1906 | United Kingdom . |
| 1182385 | 2/1970 | United Kingdom . |
| 2219333 | 12/1989 | United Kingdom . |
| WO 90/02844 | 3/1990 | WIPO . |
| WO 94/26985 | 11/1994 | WIPO . |

*Primary Examiner*—Robert Davis
*Attorney, Agent, or Firm*—Blakely Sokoloft Taylor & Zafman

[57] ABSTRACT

The invention relates to a compactor apparatus for compacting granular material, such as granulated activated carbon, when it is laid in a slow sand filter, comprising a plough, a compacting device and a mechanism to provide swivelling of the apparatus in a substantially horizontal plane whereby to compact the material. In the preferred embodiments illustrated, the apparatus is removably mounted on an end of an extensible arm of a tracked vehicle such as a dumper, excavator or digger.

16 Claims, 7 Drawing Sheets

COMPACTOR

The invention relates to a compactor, particularly to such apparatus for compacting granular material such as granular activated carbon, sand, pea shingle or the like.

The granular materials mentioned are often used in large expanses for example in filter beds in water treatment works. In such applications, it is a requirement that the material be level, and compacted so that it provides an even filtering of water, but at the same time, while the filter bed is empty, it is firm enough for its surface to remain intact if personnel, dumpers or other equipment move over it. Prior apparatus does not generally provide such a compacted layer.

It is accordingly an object of the invention to seek to provide apparatus which mitigates this disadvantage.

According to a first aspect of the invention there is provided apparatus for compacting granular material, comprising a plough means, and a compacting means whereby to compact material.

There may be means adapted to provide swivelling of the apparatus in a substantially horizontal plane.

The means may provide for substantial 360° swivelling. This provides for more or less universal compacting action.

The means may comprise a hydraulic motor. This is a relatively simple and inexpensive item.

There may be a motor/gearbox assembly and the plough means may be connected therewith and the compacting means may be pivotably connected to the plough means. This provides for "flexibility" in operation particularly where the compacting means is essentially a separate means.

There may be restraining means adapted to prevent undue separation of the plough means and compacting means. This provides for control during operation.

The restraining means may comprise flexible elongate means, such as for example chains.

The compacting means may have a curved compacting surface. This provides for a smooth compacting operation.

The compacting means may have flared lateral wings adjacent the curved surface. This provides for the obviation of furrows in the compacted surface.

The compacting means may have an inclined surface adapted in a compacting operation to prevent accumulation of granular material. This provides for efficient use of the material.

There may be means for gauging the depth of a surface being compacted.

According to a second aspect of the invention there is provided a grader or dumper having an arm, and apparatus as hereinbefore defined mounted on that arm.

Apparatus for compacting granular material, such as granulated activated carbon, is hereinafter described, by way of example, with reference to the accompanying drawings.

Figure 1:
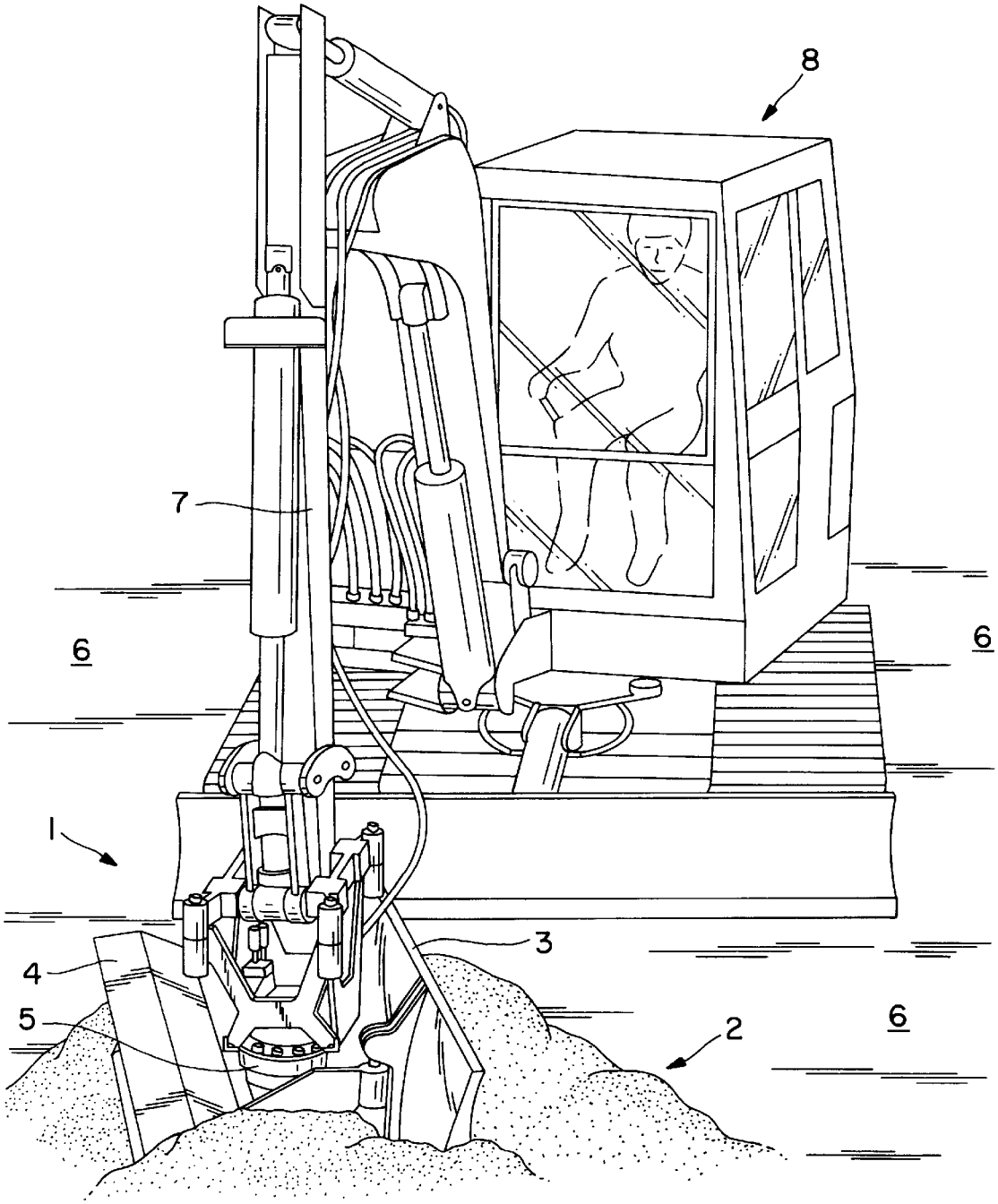
FIGS. 1 and 2 show respective views of apparatus according to the invention in use on the distal end of an arm of a digger.
Figure 2:
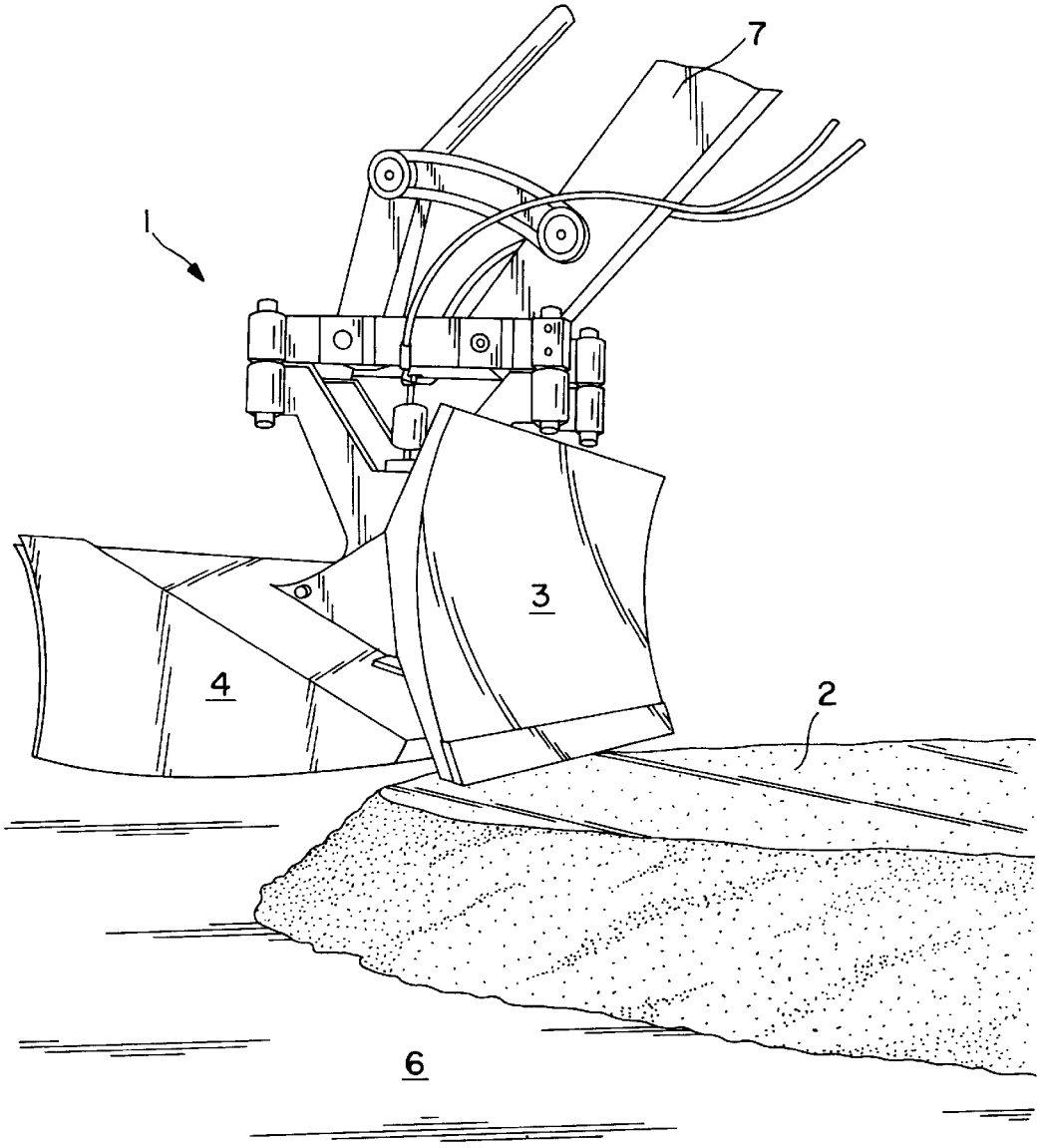
Figure 3:
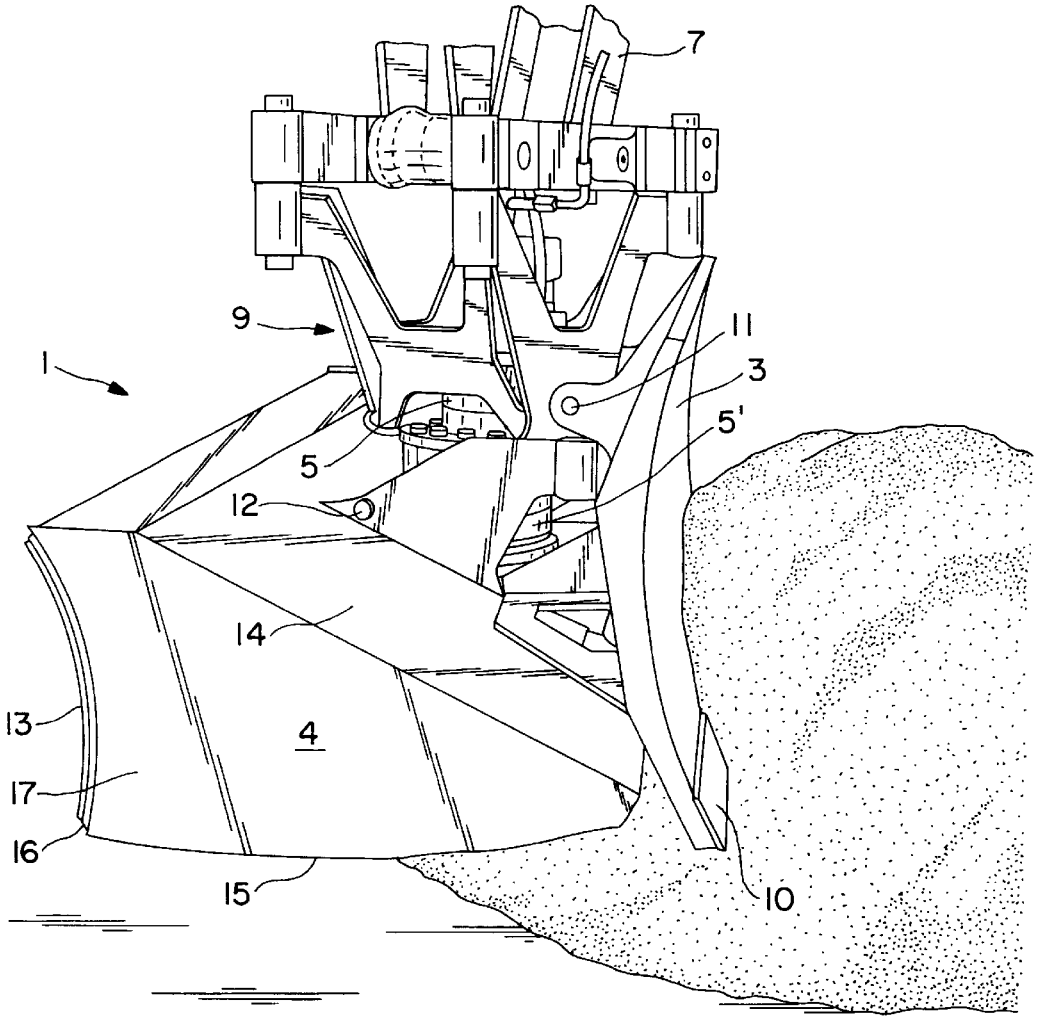
FIG. 3 shows to an enlarged scale a perspective view of the apparatus of FIGS. 1 and 2 in use.

Referring to the drawings, in which like parts are referred to by like numerals, FIGS. 1 to 4 show apparatus 1 for compacting granular material 2, comprising a plough means 3, a compacting means 4 and means 5 to provide swivelling of the apparatus 1 in a substantially horizontal plane whereby to compact material 2, in the embodiment granular activated charcoal or carbon laid as a filter layer on a bed of sand 6 (which can also be compacted using the apparatus 1). The sand 6 and carbon 2 form layers in a filter such as a slow sand filter in a water treatment works.

The apparatus 1 is designed to be removably mounted on an end of an extensible arm 7 of a tracked vehicle such as a dumper, excavator or digger 8, to a hydraulic circuit of which the means 5 in the form of a hydraulic motor, with a gearbox 5', of the apparatus 1 is connected whereby the apparatus 1 can in use be slewed or swivelled over substantially 360°. The motor 5 is mounted on a frame or yoke 9 of the apparatus 1, from which frame 9 is suspended the plough means 3 and the compacting means 4.

The plough means 3 is a curved blade which has a wear strip 10 secured to a bottom (in use) edge and which extends the full width thereof. The plough means or blade 3 is suspended from the frame 9 via a bracket assembly 3' attached to the gearbox 5', so that the plough has in use, a substantially vertical pivot axis coincident with the pivot axis of the gearbox 5'. The compacting means 4 is pivoted from the plough means by a pivot connection 11 having a substantially horizontal pivot axis. The compacting means 4 is a closed body or box having a curved outer surface 13, an inclined surface 14 and, in use, a curved lower, compacting surface 15, the surface 15 being convex towards the surface 2' being compacted. Lateral edges of the compacting means also comprise upwardly (as viewed) flared wings or edges 16 and, adjacent the curved outer surface 13, there is a ramp or wedge-shaped profile 17 leading to the curved surface 16.

The pivot connection 11 of the compacting means 3 is adjustable in height so that it can be adjusted vertically with respect to the bottom edge of the wear strip 10 of the plough means 3. A rear surface (in use) of the plough means 3 mounts stop means in the form of length-wise adjustable screws 18 against which a bearing plate 19 of the compacting means 4 can butt.

There are also restraining means 20 connected between the rear of the plough means 3 and the compacting means 4.

The restraining means 20 comprise in the embodiment two spaced apart substantially parallel metal chains which are flexible, yet when extended are rigid and prevent too great a separation of the plough means 3 and compacting means 4.

The apparatus 1 includes an upright pole (not shown) which acts as a datum for a laser level control device, which device can be mounted on a side of the slow sand filter. There is in the cab of the tracked vehicle 8 a read out or control console whereby the driver can control the level of the apparatus 1 and hence the level of the layer(s) it is compacting.

In operation, to lay a compacted layer of, in this case, granulated activated carbon 2 on a layer of sand 6, a pile or mound of carbon 2 is dumped on to a previously laid sand layer (FIGS. 1–3) and is addressed by the apparatus. First of all, the driver makes a pass or sweep of the apparatus 1, whereby the plough means 3 smooths the mound into a layer. He may make several passes, raising the apparatus 1 each time to lift the apparatus off the carbon prior to the next pass. The chains 20 keep the apparatus 1 rigid with the compacting means 4 being rigid with the plough means 3. When the driver is satisfied that all carbon is levelled to a required depth (using the laser monitor), he makes a reverse pass so that the compacting means 4 becomes the leading part (previously it was trailing behind the plough means). During such a pass, the curved surface 15 engages the (level) surface 2' of the carbon 2 and presses down on it, the surface 2' being a tangent to the curved surface 15 whereby the carbon is compacted.

The curved surface 15 thus causes the material 2 to be "squashed" into itself, providing a firm surface of the material with the granules locked, so much so that the surface is firm and is not significantly disrupted by subsequent passage thereover by personnel or machines, or the depositing of sand onto the granulated activated carbon to form a layer of sand on the carbon (GAC).

The stop 18 prevents the compacting means 4 from crashing into the plough means 3, so obviating jamming and damage.

It will be understood that as the apparatus 1 is carried by the arm 7 which carries the motor 5 and gearbox 5', a full 360° slewing or swivelling can be achieved so that levelling and compaction can be achieved at any desired angle in the horizontal plane.

During compaction, the wedge 17 provides a smooth "lead-in" to the curved compacting surface 15. The lateral wings 16 obviate the formation of lateral "waves" of material which would otherwise be formed and which would lead to a surface which would have to be levelled again.

The slope 14 prevents the build up of material on the compacting means 4 during a compacting pass while the outer curved surface 13 provides a spreading action.

Figure 4:
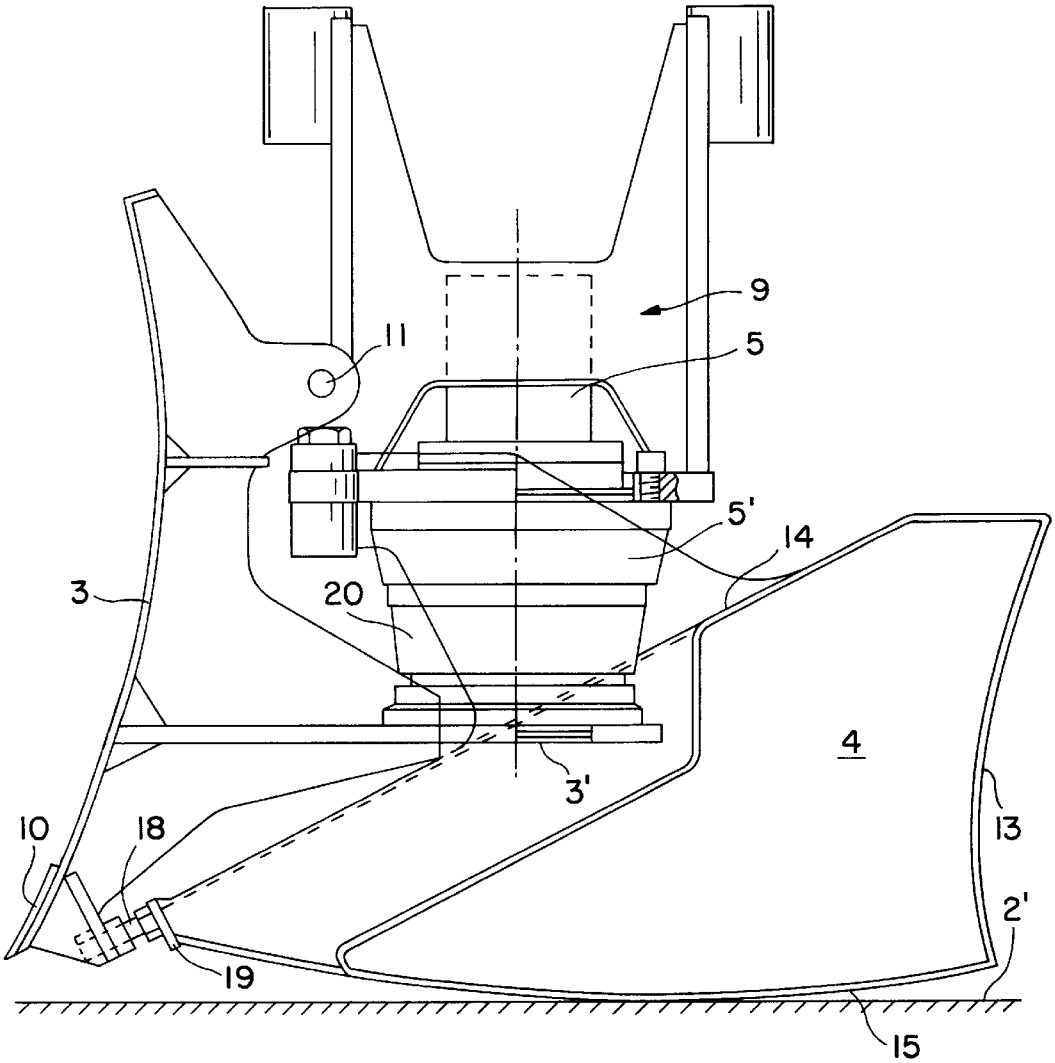
FIG. 4 is a side elevational view, to an enlarged scale, of the apparatus of FIGS. 1 to 3.
Figure 5:
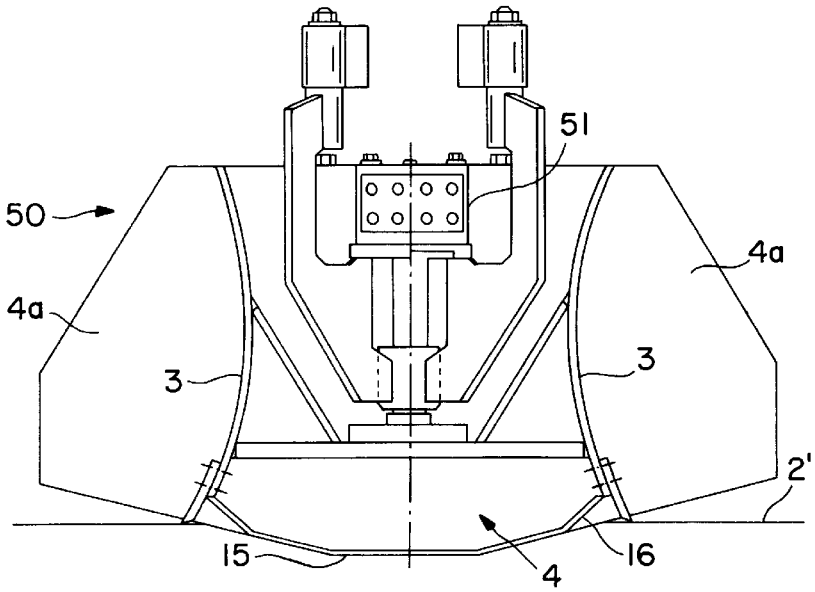
FIG. 5 shows an alternative embodiment of apparatus according to the invention.

Referring now to FIG. 5 the embodiment 50 shown there is similar to that of FIGS. 1 to 4, except that there are two plough means 3 and one compacting surface 15.

This embodiment 50 includes a semi rotary actuator 51 for rotation in opposite senses through 190°, again providing for total slewing or swivelling during levelling and compaction passes.

Figure 6:
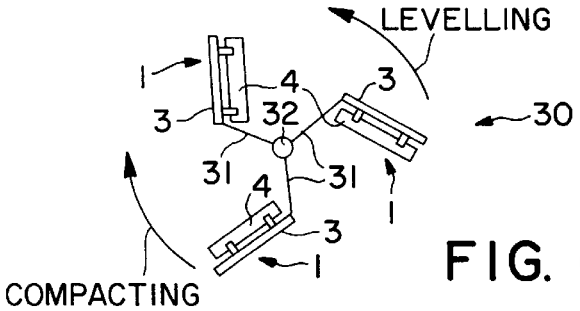
FIG. 6 is a schematic plan view of another embodiment of apparatus according to the invention.

FIG. 6 shows schematically an embodiment 30 in which there are three apparatus 1 operating on respective arms 31 from a central actuator 32 and which rotate counter clockwise for levelling and clockwise for compacting.

Figure 7:
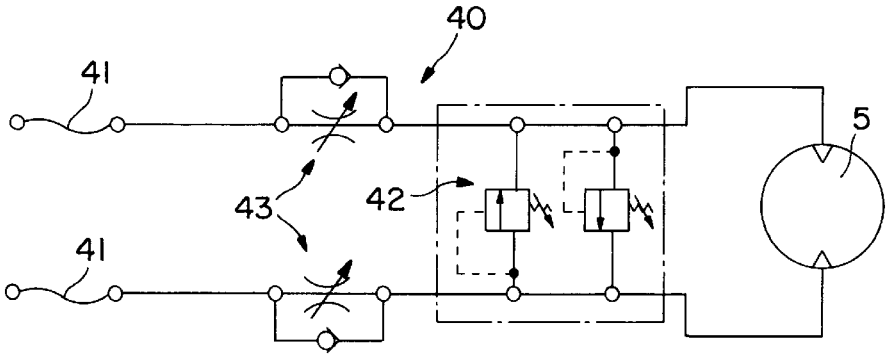
FIG. 7 is a schematic view of a hydraulic circuit for operation of a compactor according to the invention.

FIG. 7 shows a hydraulic circuit 40. There are hydraulic connections 41 for connection with a hydraulic circuit of the dumper, digger or excavator 8, the circuit including the hydraulic motor 5 and gearbox 5' and including dual cross line relief valves 42 as well as standard flow valves 43. The relief valves protect the motor. In a modification of the circuit, not shown, there are pilot operated check valves which can be operated so that the apparatus moves material or spoil being laid and compacted to one end, the pilot operated check valves being in neutral, the circuit being locked solid apart from the cross-line relief valves 42 which allow the plough means to move slightly so that the spoil spills gently out. The valves 42 can be operated to bring back spoil.

As an alternative to a laser depth monitor, there may be a V-gauge which digs into the material for a visual inspection by the driver to assess the depth achieved. There may also be side wings 4*a* on the front of the plough means to contain material during ploughing.

Figure 8:
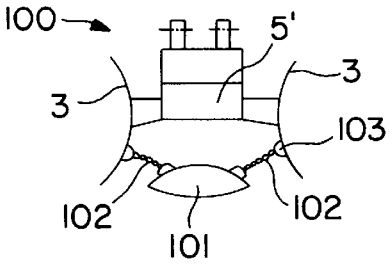
FIGS. 8–11 are respectively schematic end elevational views of further embodiment of apparatus according to the invention, to a much smaller scale.

Referring now to FIG. 8, there is shown an embodiment 100 which is an alternative to that shown in FIG. 5. In this embodiment 100, there is a compactor 101 which is in the form of a curved or "lozenge" shaped-skid "floating"between the two pough means 3, the skid being suspended from the plough means 3 by two flexible but inextensible support means in the form of chains 102. This embodiment is relatively easy to control. Thus if the laser height control shows that the height is even momentarly above target, the apparatus can be moved downwardly via the arm 7 with a lesser force, so avoiding breaking up or comminution of the sand or carbon, whilst allowing compaction by the skid 101, the chains allowing it to "rise" whilst nevertheless being maintained rigidly connected thereby for movement with the arm on slewing, for compaction, following either the right or left plough means, as viewed, depending on the slewing direction. The skid may be detachable from the plough means via quick-release couplings such as shackles and pins 103. The shackles 103 are effectively lower than the pivot 11 and these provide a "floating" skid which does not "dig" into the material 2, as can happen with a (higher) pivot 11. The skid works the same in both directions.

Figure 9:
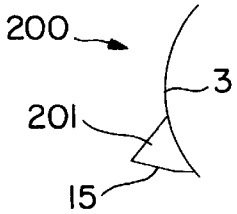

Referring now to FIG. 9, the embodiment 200 shown there has a compacting means in the form of a full length pad 201 with a curved surface 15 extending the width of the plough means 3. Thus in use an area of granulated active carbon could be spread by the plough means 3, moving in one direction, and then the plough means could be reversed, at a slightly lower level, having been lowered by the arm, and the full width pad 201 and its curved compacting surface produces the required compaction.

Figure 10:
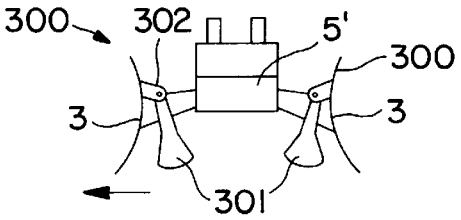

Referring now to FIG. 10. the embodiment 300 shown has two relatively narrow compacting means pivoted one from the rear of each plough means 3. The arrow shows the direction of assumed movement with the right hand compacting means 301 in contact with the surface being compacted. The two plough means and compacting means provide for compaction and spreading in two opposite directions. The relatively narrow skids (narrower than in other embodiments) offer less resistance when the apparatus 300 is moved downwards onto a surface to be spread and compacted. The skids 301 can be "stowed" above the lower level of the plough means, by suitably operating links by which the skids are connected with the plough means.

This is useful when a surface 2' is being levelled, but does not require compaction. This may be the case when laying and levelling a sand layer. Moreover, the skids may be connected by a linkage (not shown) so that they always work in tandem, or can be stowed together, so as to allow operation in the plough means mode. The links 302 shown may be gravity operated so that depending on the direction of motion, one skid will be deployed for compaction.

Figure 11:
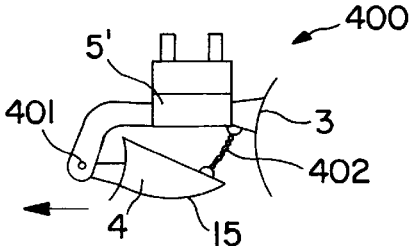

Referring now to FIG. 11, the embodiment 400 has a plough means 3 and a compacting means 4 which is essentially similar to that of FIG. 4, but is turned round, being pivoted on a point 401 instead of on the plough means 3 which is as before pivoted to the gearbox 5'. There is a chain linking the compacting means 4 to the plough means 3. During compaction, the direction being shown by the arrow, the surface 15 compacts say granular activated carbon, after movement in the opposite direction for levelling by the plough means 3.

Figure 12:
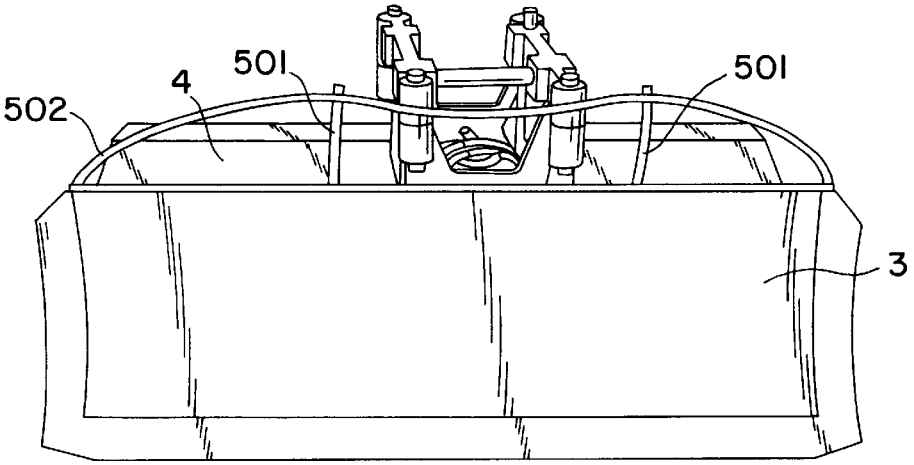
FIGS. 12 and 13 are respectively a front elevational view and a perspective view from the rear of a yet further embodiment of apparatus according to the invention.
Figure 13:
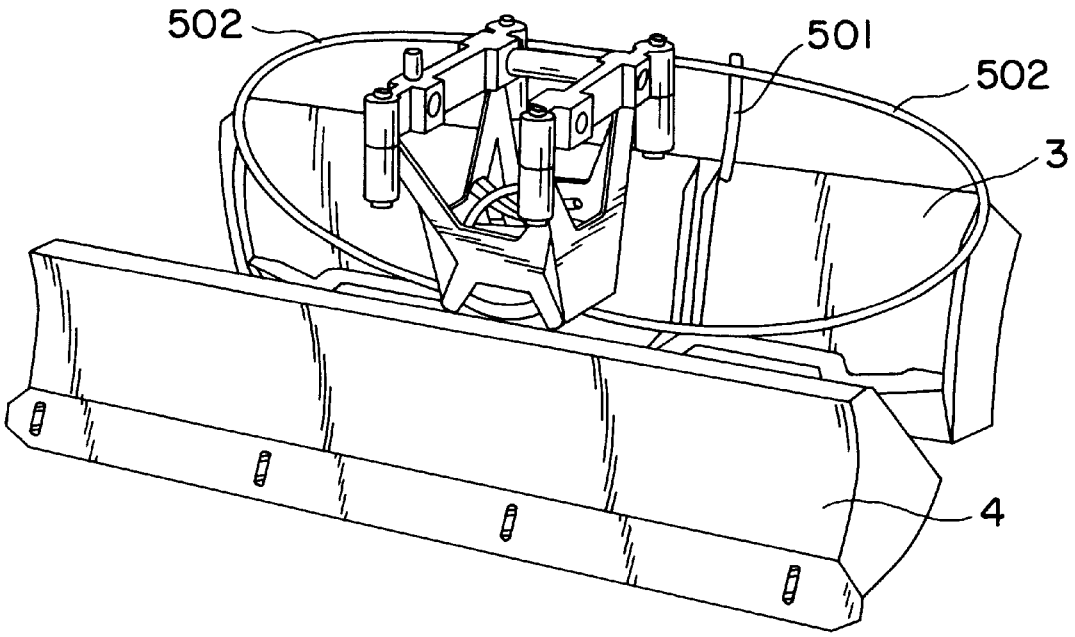

FIGS. 12 and 13 show views of the apparatus of FIG. 4 where there is means to provide for monitoring the horizontal attitude of the cutting or lower edge of the plough means. This is achieved in the embodiment shown by clamping two vertical support tubes 501 to the rear of the plough means and clamping a transparent manometer tube 502 between them. The manometer is filled with a coloured liquid so that as the liquid moves in the tube, the operator can see whether or not it is level, like a spirit level, so enabling him to monitor whether the plough means is out of level, and make necessary corrections if it is.

The manometer tube could be a closed loop, which would obviate contamination and spillage of the coloured liquid.

The plough means 3 in the embodiments illustrated may be of relatively limited height. This would enable the apparatus to continue working to level even if a mound is encountered as the apparatus will continue moving, with material of the mound spilling over the blade.

It will be understood that in every embodiment there is provided in one apparatus both a levelling and compacting device which can save up to 75% of the time normally used to lay material in a slow sand filter and can deal with several mounds of material in one series of passes. The apparatus 1 etc. is both rotated by the gearbox 5' horizontally, and slewed by the arm 7 of the device 8. This combination provides fine control.

It will also be understood that the apparatus mentioned herein may be modified. For example, the bottom edge of the plough means may include a plurality of spaced apart teeth. These teeth may be in addition to, or replacement for, the wear-strip 10. The teeth may thus be an "add-on" feature.

It will yet further be understood that the rotation may be less than 360°, for example only over substantially 180°.

What is claimed is:

1. Apparatus for compacting granular material, comprising a plough means, and a compacting means for compacting material, said apparatus further comprising means adapted to provide swivelling of the apparatus in a substantially horizontal plane, said swivelling means providing for substantial 360° swivelling.

2. Apparatus according to claim 1, the means comprising a hydraulic motor.

3. Apparatus according to claim 2, comprising a motor/gearbox assembly, the plough means being connected therewith and the compacting means being pivotably connected to the plough means.

4. Apparatus according to claim 3, there being restraining means adapted to prevent undue separation of the plough means and compacting means.

5. Apparatus according to claim 4, the restraining means comprising flexible elongate means.

6. Apparatus according to claim 1, the compacting means having a curved compacting surface.

7. Apparatus according to claim 6, the compacting means having flared lateral wings adjacent the curved surface.

8. Apparatus according to claim 6 or claim 7, the compacting means having an inclined surface adapted in a compacting operation to prevent accumulation of granular material.

9. Apparatus according to claim 6, the compacting means being detachable.

10. Apparatus according to claim 9, there being two plough means and the compacting means comprising two separate compacting means each pivoted to a respective plough means.

11. Apparatus according to claim 10, the two compacting means being linked by link means.

12. Apparatus according to any of claims 1 or 2, the compacting means being part of the plough means.

13. Apparatus according to claim 1, comprising means to monitor the horizontal level of the plough means.

14. Apparatus according to claim 13, the monitor means comprising a manometer.

15. Apparatus according to claim 1, including means for gauging the depth of a surface being compacted.

16. A grader or dumper having an arm, and apparatus according to claim 1, mounted on that arm.

* * * * *